US006259417B1

(12) United States Patent
Kim et al.

(10) Patent No.: US 6,259,417 B1
(45) Date of Patent: Jul. 10, 2001

(54) COLLINEAR ANTENNA FOR PORTABLE RADIO AND METHODS FOR MAKING SAME

(75) Inventors: Brian S. Kim, Englishtown; Edwin A. Muth, Aberdeen; Peter Suprunov, East Brunswick, all of NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/382,365

(22) Filed: Aug. 24, 1999

(51) Int. Cl.[7] ..... H01Q 1/52
(52) U.S. Cl. ..... 343/841; 343/702
(58) Field of Search ..... 343/841, 702, 343/790, 791, 792

(56) References Cited

U.S. PATENT DOCUMENTS 5,617,105 * 4/1997 Tsunekawa et al. ..... 343/702
5,926,149 * 7/1999 Rummeli et al. ..... 343/791

* cited by examiner

*Primary Examiner*—Tan Ho
*Assistant Examiner*—Ephrem Alemu
(74) *Attorney, Agent, or Firm*—Priest & Goldstein, PLLC

(57) ABSTRACT

An antenna for use with portable radio and telephone equipment includes a main radiator and a shield plate. One end of the shield plate is attached to the outer conductor of a coaxial cable abutting the shield plate. The main radiator is attached to the inner conductor of the coaxial cable a predetermined distance away from the shield plate. The main radiator and shield plate are mounted inside an antenna housing. The shield plate includes a head section having a pair of deformable tabs forming a positioning clip for holding the outer conductor of the coaxial cable. The inner conductor of the coaxial cable extends beyond the positioning clip for attachment to the main radiator.

19 Claims, 12 Drawing Sheets

COLLINEAR ANTENNA FOR PORTABLE RADIO AND METHODS FOR MAKING SAME

BACKGROUND OF THE INVENTION

1. Field of the Invention

The present invention relates generally to improvements in portable electronic devices utilizing antennas, and particularly to advantageous aspects of a collinear antenna fed by a coaxial cable that provides omni-directional composite coverage for portable radio equipment and the like.

2. Description of the Prior Art

In recent years, cordless telephones and other portable radio equipment have been put to wide practical use. Portable radio systems typically include a base unit having an antenna mounted to its housing, and a two-way handset radio unit having a second antenna that communicates with the base unit. Such portable radio equipment uses a high-frequency band ranging from 400 MHz to 2.4 gHz. The handset radio unit must operate within the area covered by the base unit to maintain receiving and transmitting functions. The antenna is arguably one of the most important parts of the base and handset units.

It is desirable for the size and weight of the base and handset units to be reduced as much as possible. As the size and weight of the base and handset units are reduced, the antenna must also be reduced in size while maintaining desired electrical characteristics, such as resonance frequency, bandwidth, and gain. Further, the market for portable radio and telephone equipment is highly competitive. As the prices of these products continue to be reduced, it is desirable to use a low-cost antenna with good repeatability and ease of assembly.

SUMMARY OF THE INVENTION

One aspect of the present invention provides an antenna for use with portable radio and telephone equipment. In accordance with this aspect of the invention, there is provided an antenna having a main radiator and a shield plate. One end of the shield plate is attached to the outer conductor of a coaxial cable abutting the shield plate. The main radiator is attached to the inner conductor of the coaxial cable a predetermined distance away from the shield plate The main radiator and shield plate are mounted inside an antenna housing. In accordance with a further aspect of the invention, the shield plate includes a head section having a pair of deformable tabs that form a positioning clip for holding the outer conductor of the coaxial cable. The inner conductor of the coaxial cable extends beyond the positioning clip for attachment to the main radiator.

Additional features and advantages of the present invention will become apparent by reference to the following detailed description and accompanying drawings.

DETAILED DESCRIPTION

Figure 1:
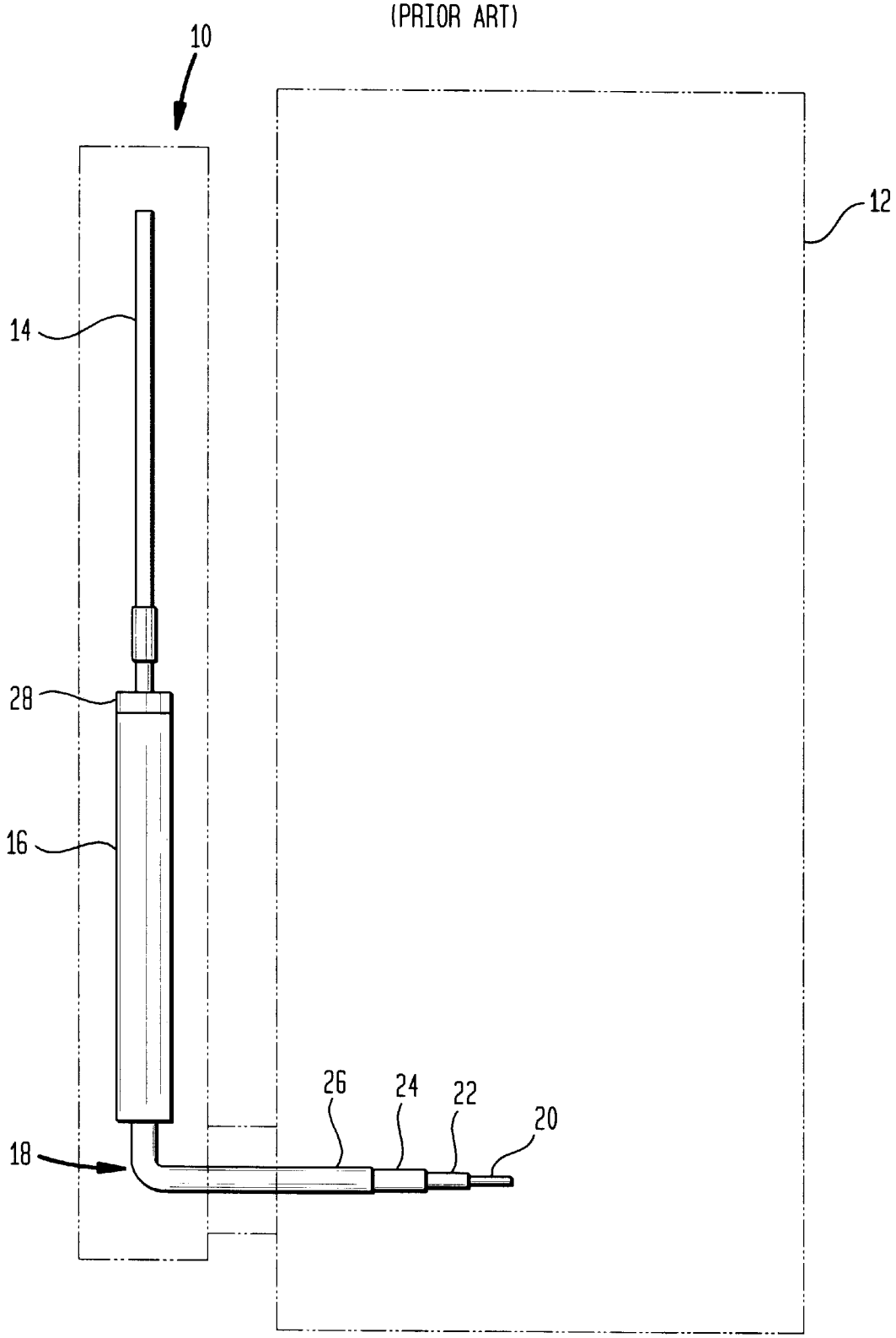
FIG. 1 (PRIOR ART)
FIG. 1 shows a front view of an antenna according to the prior art.

FIG. 1 shows a front view of a collinear antenna 10, according to the prior art, for use with a portable telephone or radio 12. The antenna includes two sections: a main radiator 14, and a shield pipe 16. The main radiator 14 is typically formed from a copper wire or other suitable conductor. The shield 16, which functions as a ground plane for the antenna 10, is typically formed from a rigid tube fabricated from a conductive metal.

The main radiator 14 and the shield 16 are electrically connected to the telephone or radio 12 by means of a coaxial cable 18. The coaxial cable 18 includes an inner conductor 20, an inner insulator 22 surrounding the inner conductor 20, an outer conductor 24 surrounding the inner insulator 22, and an outer insulator 26 surrounding the outer conductor 24. As described below, the inner conductor 20 is fed through the shield pipe 16 and then soldered to the main radiator 14. The outer conductor 24 is electrically connected to the shield pipe 16 using a mounting device 28, as shown in FIGS. 2–4 and described below.

Figure 2A:
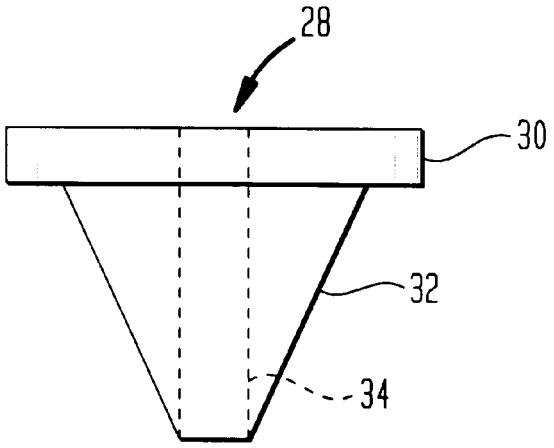
FIG. 2A (PRIOR ART)
FIGS. 2A and 2B show, respective, front and top views of a coaxial cable mounting device according to the prior art for use with the antenna shown in FIG. 1.
Figure 2B:
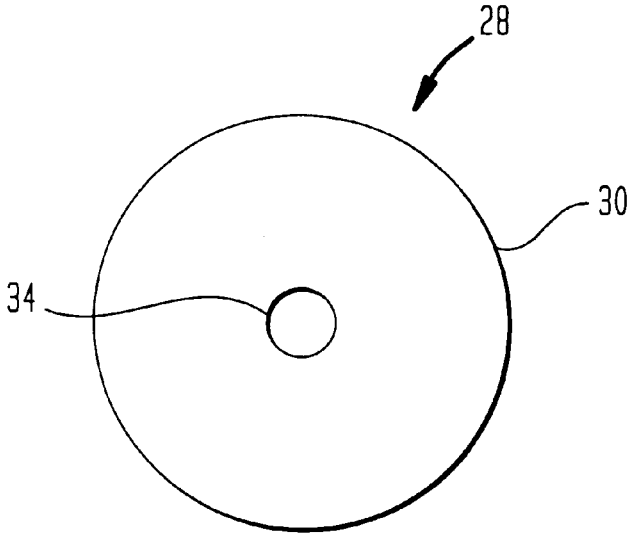
FIG. 2B (PRIOR ART)

FIGS. 2A and 2B show, respectively, front and top views of a mounting element 28 according to the prior art that is used to electrically connect the coaxial cable 18 to the shield pipe 16 in the antenna shown in FIG. 1. The mounting element 28 is fabricated from a conductive metal. As shown in FIGS. 2A and 2B, the mounting element 28 has an upper lip 30 that fits over the upper mouth of the shield pipe 16, and an inverted conical projection 32 that fits within the upper mouth of the shield pipe 16. In addition, the mounting element 28 has an opening 34 sized to receive the inner conductor 20 and the inner insulator 22 of the coaxial cable 18.

Figure 3:
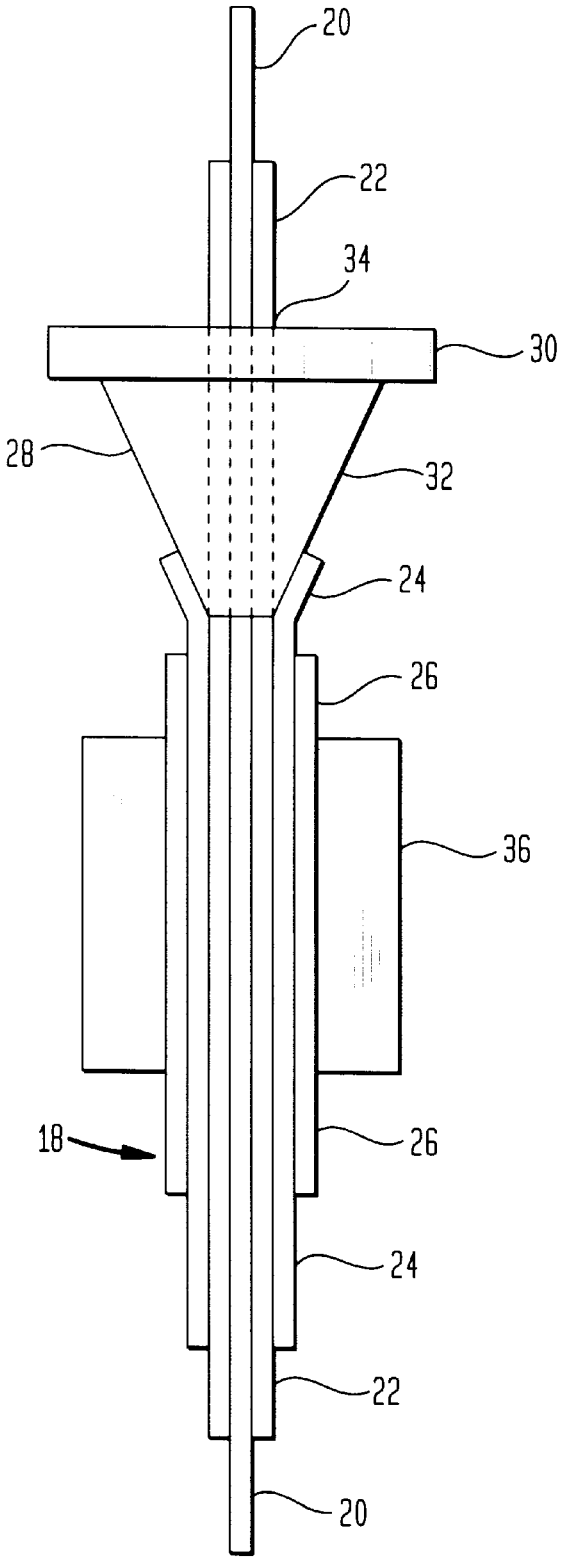
FIG. 3 (PRIOR ART)
FIG. 3 shows a cross sectional view of a coaxial cable attached to the mounting device shown in FIGS. 2A and 2B.
Figure 4:
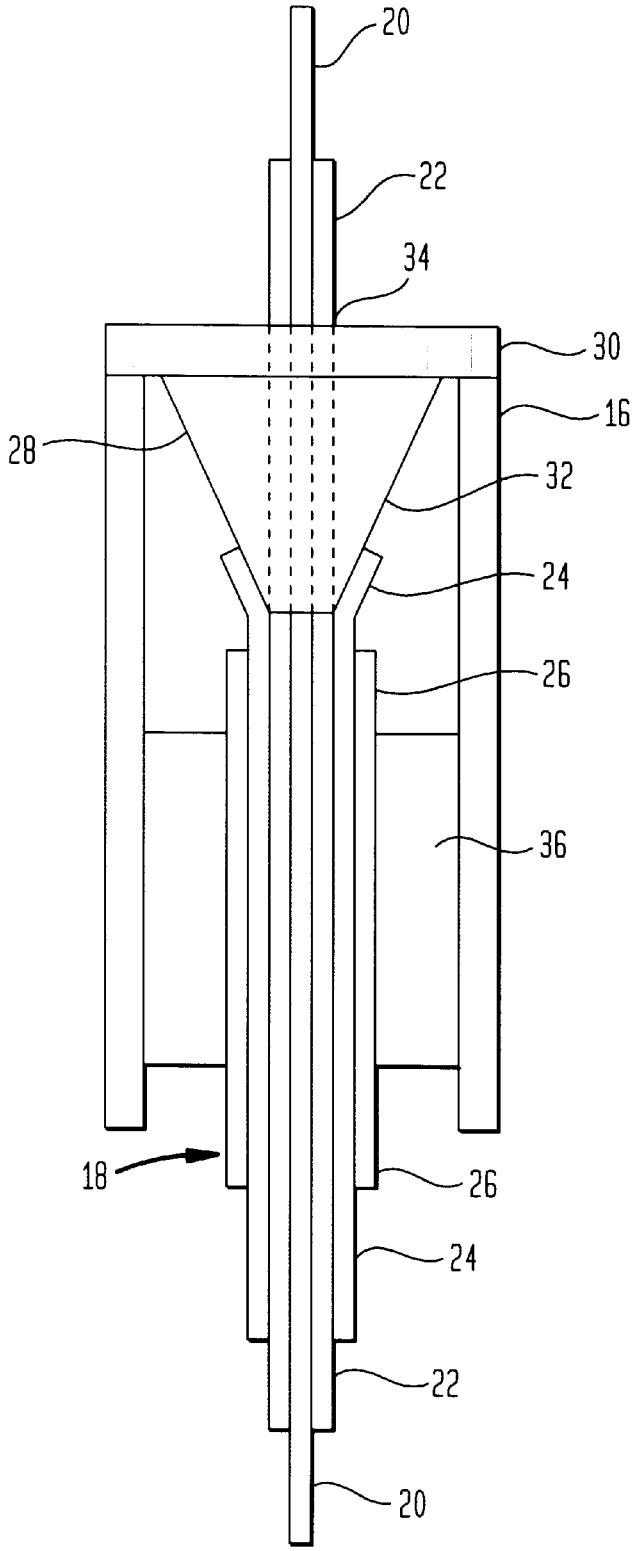
FIG. 4 (PRIOR ART)
FIG. 4 shows a cross sectional view of the coaxial cable and mounting device shown in FIG. 3 mounted into a shield pipe according to the prior art.

FIG. 3 shows a cross section of the coaxial cable 18 attached to the mounting element 28. Prior to attaching the cable I 8 to the mounting element 28, a dielectric sleeve 36 is placed around the coaxial cable 18. The sleeve 36 serves to stabilize the position of the coaxial cable 18 within the shield pipe 16. As shown in FIG. 3, a length of the inner conductor 20 and the inner insulator 22 has been exposed by stripping away the outer conductor 24 and outer insulator 26. The inner conductor 20 and inner insulator 22 are then threaded through the opening 34 in the mounting element 28. The inner conductor 20 is now available for soldering to the main radiator. The coaxial cable's inner insulator 22 serves to insulate the inner conductor 20 from the mounting element 28.

A portion of the outer insulator 26 is stripped away to expose a section of the outer conductor 24 at the point of the inverted conical projection of the mounting element 28. The outer conductor 24 is typically fabricated from braided conductive metal. The braided construction allows the exposed portion of the outer conductor 24 to be spread to fit over the point of the inverted conical projection and then soldered into place.

As shown in FIG. 4 (not drawn to scale), after the coaxial cable 18 has been attached to the conical mounting element 28, the tail end of the coaxial cable 18 is threaded through the shield pipe 16 until the lip 30 of the mounting element 28 is flush with the mouth of the shield pipe 16. The conical mounting element is then soldered into place. As mentioned above, dielectric sleeve 36 stabilizes the position of the coaxial cable 18 within the shield pipe 16.

The above-described prior art method for fabricating a collinear antenna has a relatively high cost. The parts used to practice the prior art method, including the shield pipe 16 and the mounting element 28, are relatively expensive. Further, the method used to construct the antenna is relatively time-consuming and requires a fair amount of skill on the part of the worker, which also contributes to the expense of the prior art antenna. Thus, there is a need for a collinear antenna that is more economical to produce, while providing a high level of performance.

Figure 5:
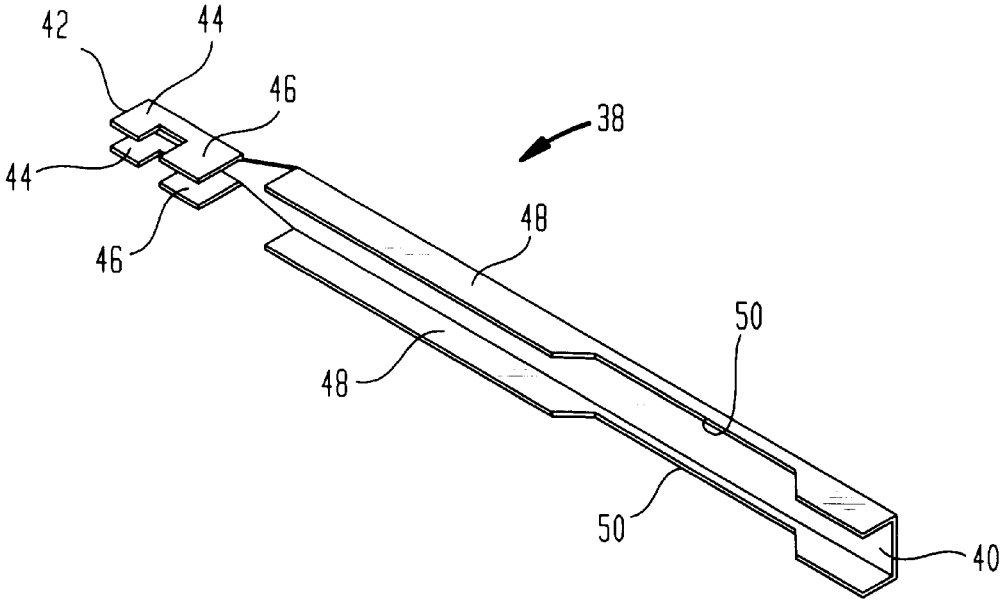
FIG. 5 shows a perspective view of an antenna shield according to the present invention.

FIG. 5 shows a perspective view of an antenna shield 38 according to the present invention. As described below, the shield 38 is used in conjunction with a main radiator element, described below, to provide a collinear antenna for use with a portable telephone or radio. The shield 38 includes a flat plate section 40 and a narrower head section 42 extending from the plate section. The head section 42 includes a first pair of opposing side tabs 44 and a second pair of opposing side tabs 46 between the first pair of side tabs 44 and the plate section 40. Each pair of opposing side tabs, which are substantially perpendicular to the head section of the shield, forms a clip for attaching the shield to a coaxial cable, as described below. In addition, the plate section 40 includes a pair of side panels 48, which are substantially perpendicular to the plate section 40. The side panels 48, together with the plate section 40, form a bridge. In addition to its electromagnetic properties, the bridge shape is useful for stabilizing the position of the shield 38 relative to a coaxial cable, as described below, as well as providing contact surfaces that are useful in positioning and mounting the shield 38 within an antenna housing. As further shown in FIG. 5, each side panel 48 includes a notch 50. As shown and described below, these notches facilitate the use of a pivot mount in attaching the antenna to a telephone, radio, or other device.

Figure 6:
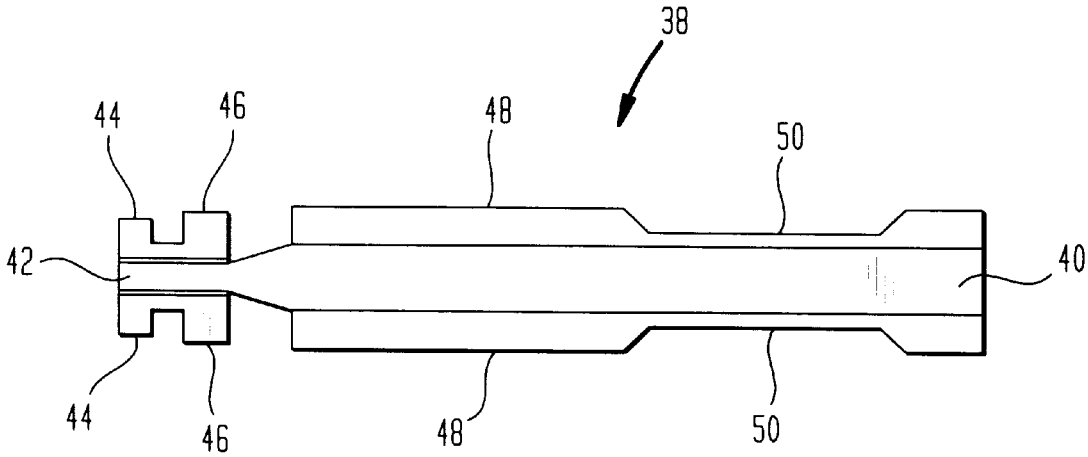
FIG. 6 shows a plan view of the antenna shield shown in FIG. 5 prior to being folded into shape.

In a presently preferred embodiment, the shield 38 is cut from a single sheet of metal and then folded into the desired shape. FIG. 6 shows a plan view of the antenna shield 38 prior to folding. The present embodiment of the invention is fabricated from copper that has been plated with nickel. However, it would be possible to use other materials, as desired. The sheet of metal is thin enough so that, after the shield has been folded into the shape shown in FIG. 5, the side panels 48, head section 42, and first and second clips 44, 46 are deformable using pliers or another appropriate tool.

Figure 7:
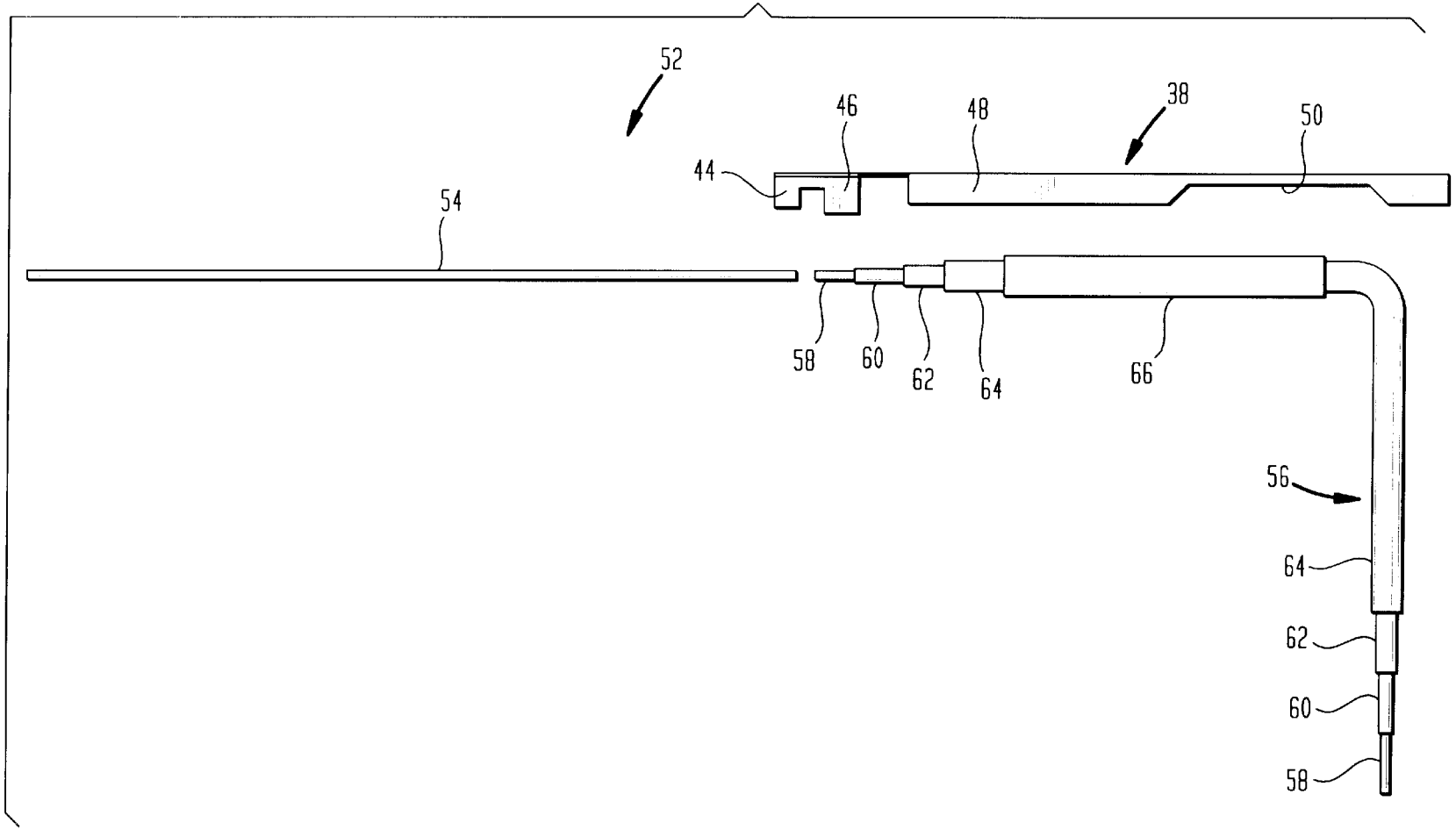
FIG. 7 shows an exploded side view of an antenna using the antenna shield shown in FIG. 5.

FIG. 7 shows an exploded side view of an antenna 52 using the shield 38 shown in FIGS. 5 and 6. The antenna 52 includes a main radiator 54 and a coaxial cable 56 having an inner conductor 58, an inner insulator 60, an outer conductor 62, and an outer insulator 64. The length of both the main radiator 54 and the shield 38 is approximately one-quarter of a wavelength. The antenna end of the coaxial cable 56 is stripped to expose predetermined lengths of the layers of the cable. The exposed portion of the outer conductor 62 lines up with the first clip 44 of the shield 38, and the end of the outer insulator 64 lines up with the second clip 46. The inner insulator 60 and the inner conductor 58 extend beyond the first clip 44, in order to allow the tip of the inner insulator 58 to be attached to the main radiator 54 at a predetermined distance from the shield 38. A sleeve 66 fabricated from polyvinyl chloride (PVC) or other suitable dielectric material is placed over the coaxial cable 56 to help stabilize the position of the coaxial cable 56 relative to the shield 38.

Figure 8:
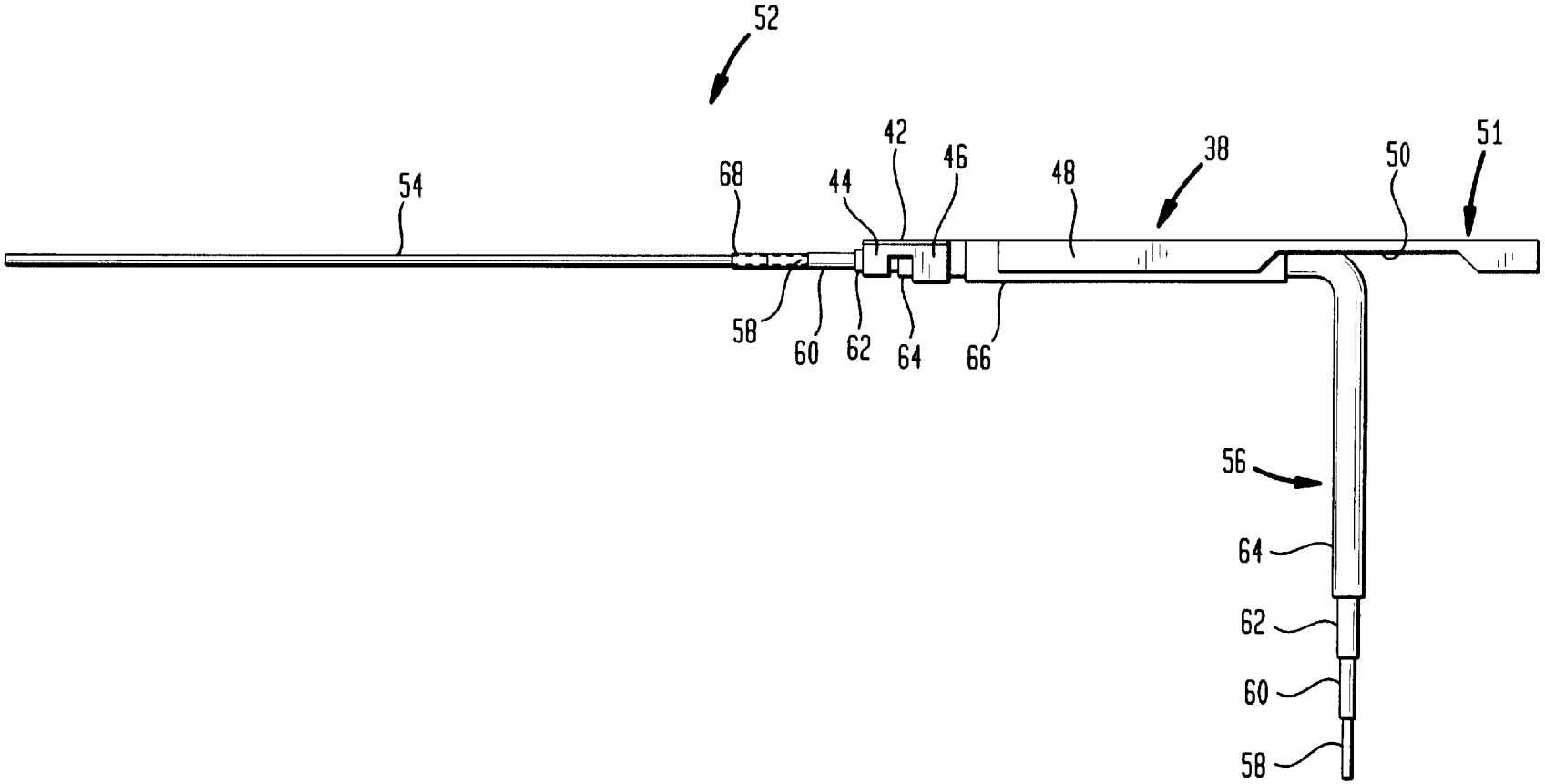
FIG. 8 shows a side view of the assembled antenna shown in FIG. 7.

FIG. 8 shows a side view of an assembled antenna according to the present invention. As mentioned above, the side panels 48 and clips 44, 46 of the shield 38 are deformable. Thus, after the coaxial cable and dielectric sleeve are positioned within the shield, the tabs of first clip 42 are bent to grip the outer conductor 62, the tabs of second clip 46 are bent to grip the outer insulator 64, and the side panels 48 are bent to grip the dielectric sleeve 66. The head section 42, which is also deformable, can be bent slightly towards the coaxial cable to bring the clips 44, 46 into closer contact with the outer conductor 62 and the outer insulator 64 of the coaxial cable 56. The portion of the outer conductor that is gripped by the first clip 44 is then soldered to make a firm connection. After the shield 38 has been attached to the coaxial cable 56, the main radiator is soldered to the tip of the inner conductor 58. A shrink-wrap sleeve 68 (shown in broken lines) is placed over the solder point for protection and insulation. As shown in FIG. 8, the coaxial cable 56 is folded away from the shield 38, leaving a tail portion of the shield 51 that does not abut the coaxial cable 56. It has been found through experimentation that this geometry improves antenna performance because it provides some isolation of the ground plane from the ground path.

Figure 9:
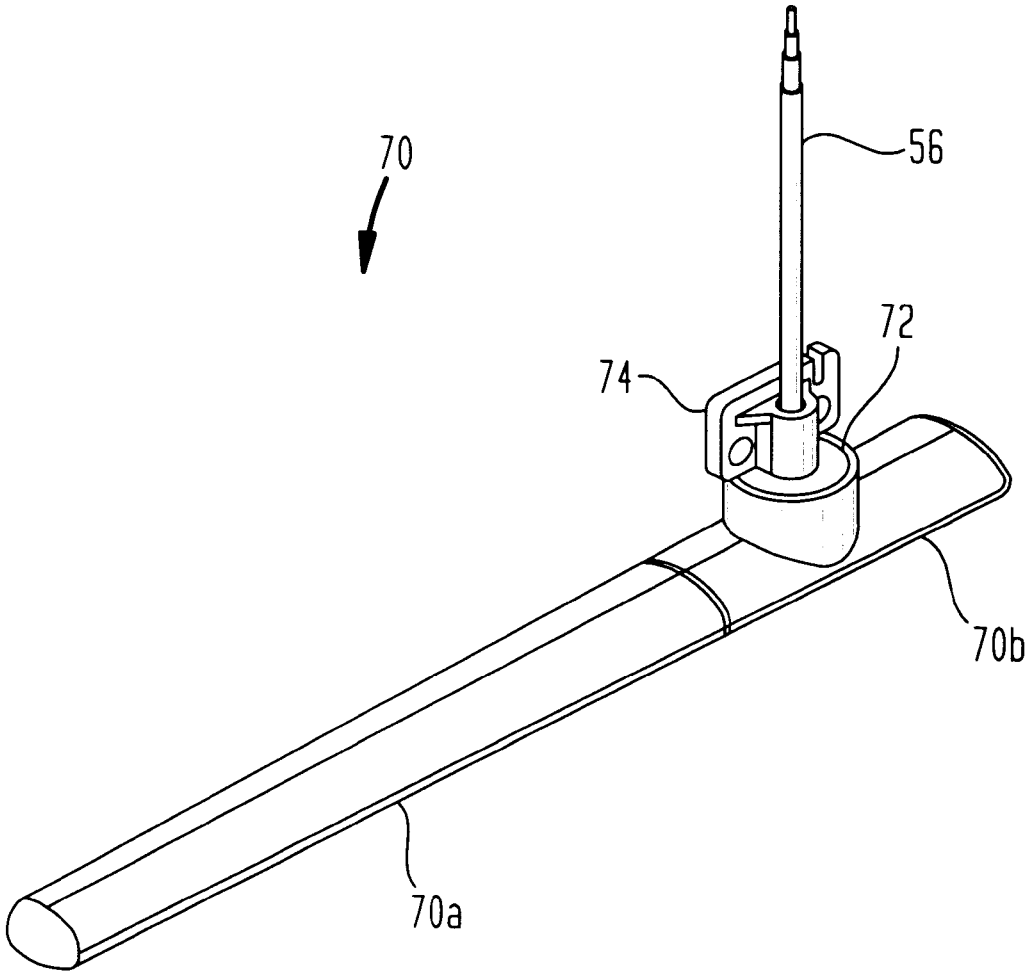
FIG. 9 shows a perspective view of the antenna shown in FIG. 8 mounted into an antenna housing.

Once the components of the antenna have been assembled, the antenna is then loaded into an antenna housing. FIG. 9 shows a perspective view of a first embodiment of an antenna housing 70 for use with an antenna according to the present invention. The antenna housing includes an upper section 70*a* and a lower section 70*b*. The lower section 70*b* of the antenna housing is provided with a pivot mount 72 and a bracket 74 for attachment to the housing of a telephone, radio, or other device. The tail end of the coaxial cable 56 is fed into the interior of the device housing for connection to the device circuitry, typically on a printed circuit board, using techniques known in the art.

Figure 10:
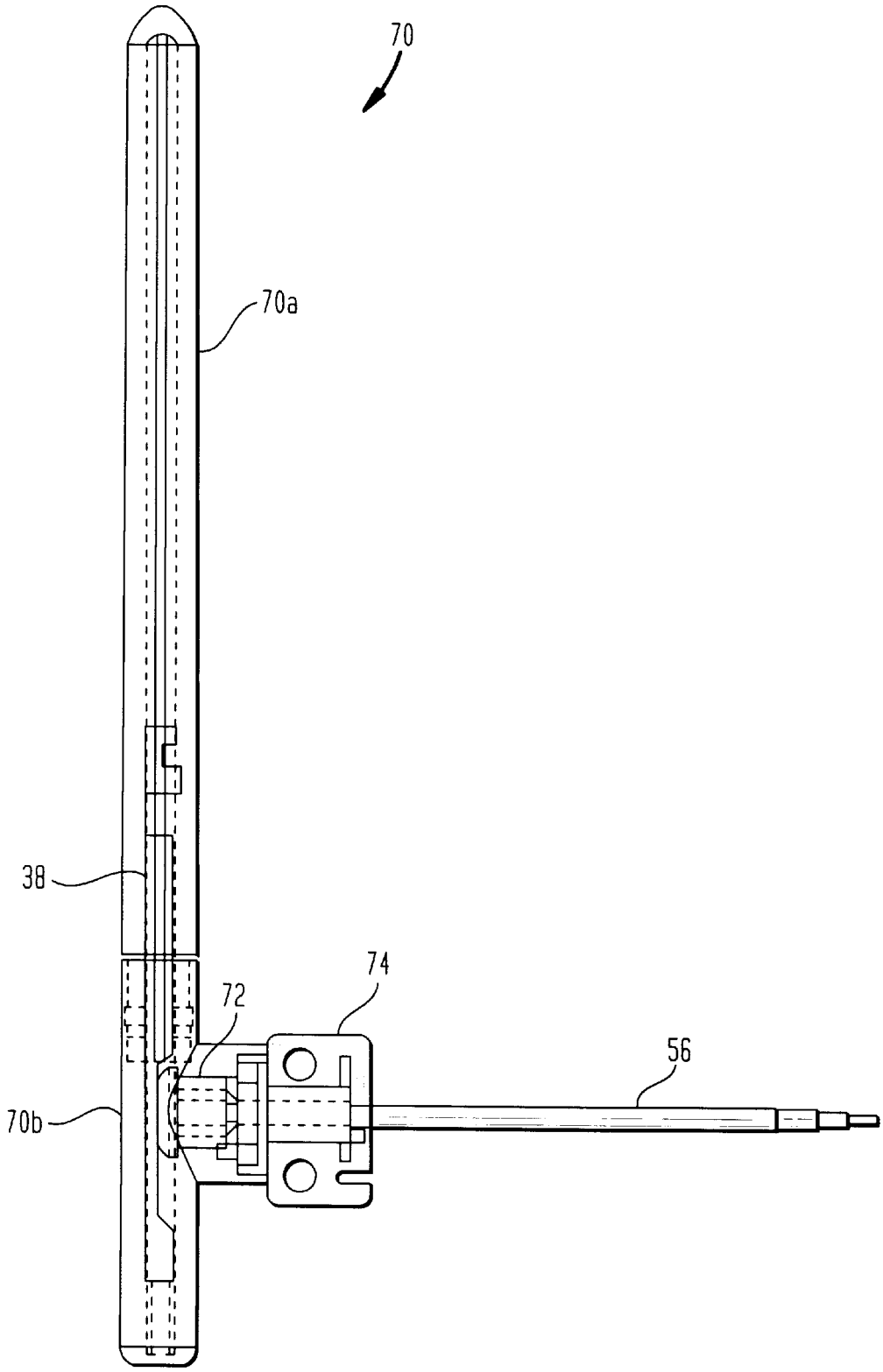
FIG. 10 shows a front view of the antenna shown in FIG. 9.

FIG. 10 shows a front view of the antenna housing shown in FIG. 9 illustrating the position of the shield 38 relative to the housing. FIG. 10 also shows the purpose of the notches in the side panels of the shield 38. As shown in FIG. 10, these notches provide space for the pivot mount 72 used to attach the antenna to a telephone or other device.

Figure 11:
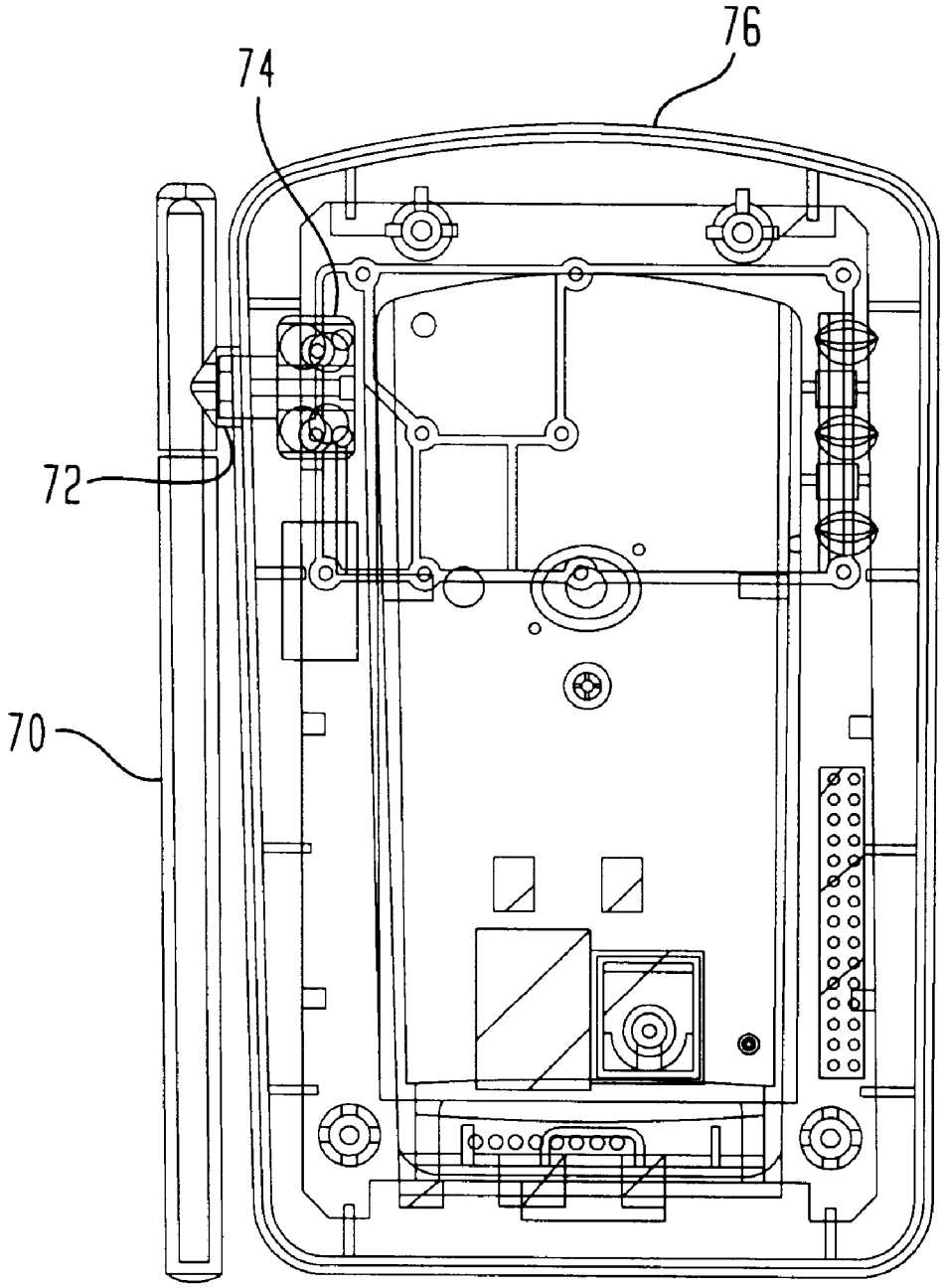
FIG. 11 shows a front view of the antenna shown in FIG. 10 mounted to the housing of a receiving device.

FIG. 11 shows a cross sectional view of the antenna housing 70 mounted to a housing 76 of a portable telephone base unit according to the present invention.

Figure 12A:
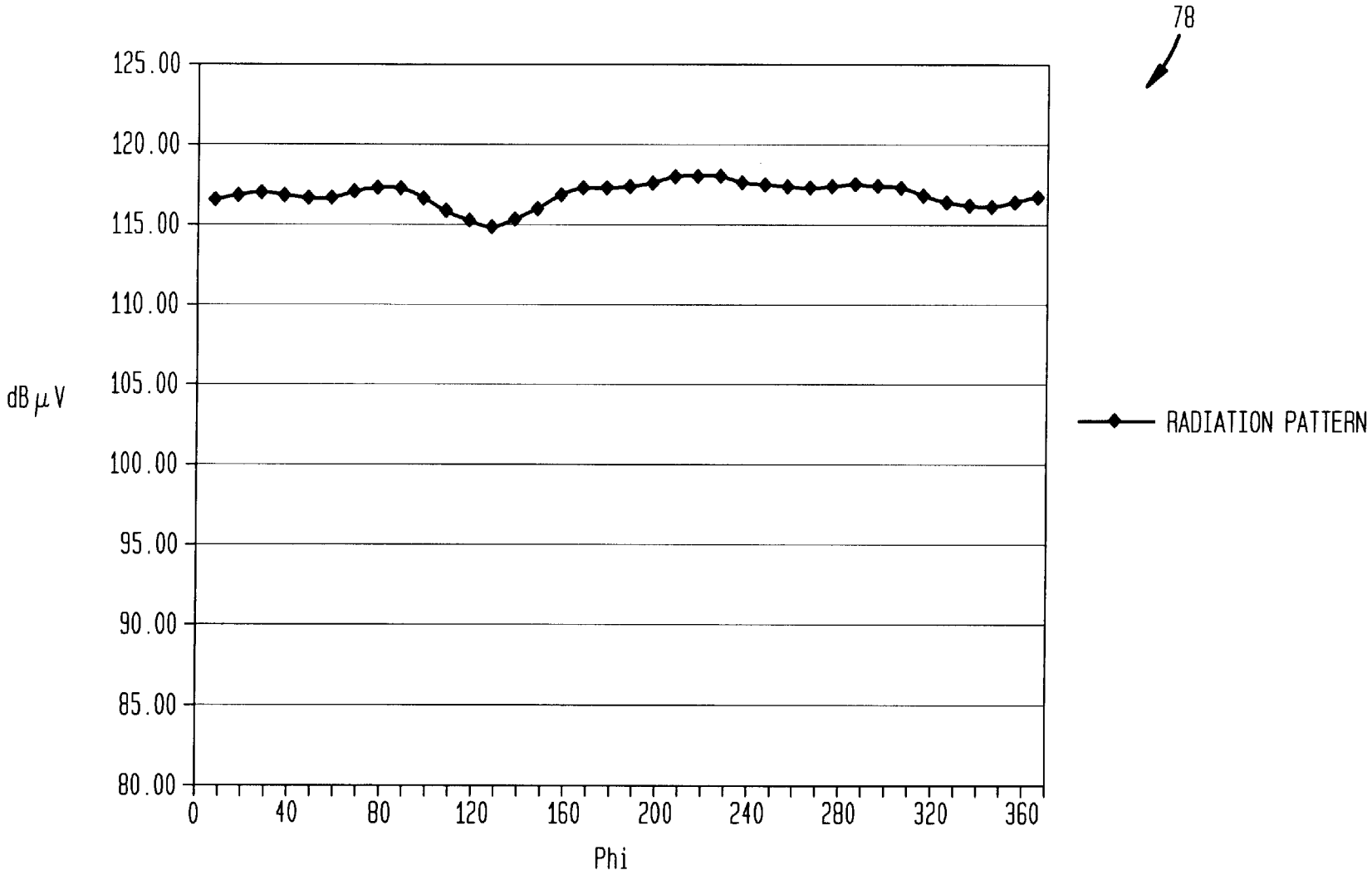
FIG. 12A shows a graph of the radiation pattern of the antenna and receiving device shown in FIG. 11.
Figure 12B:
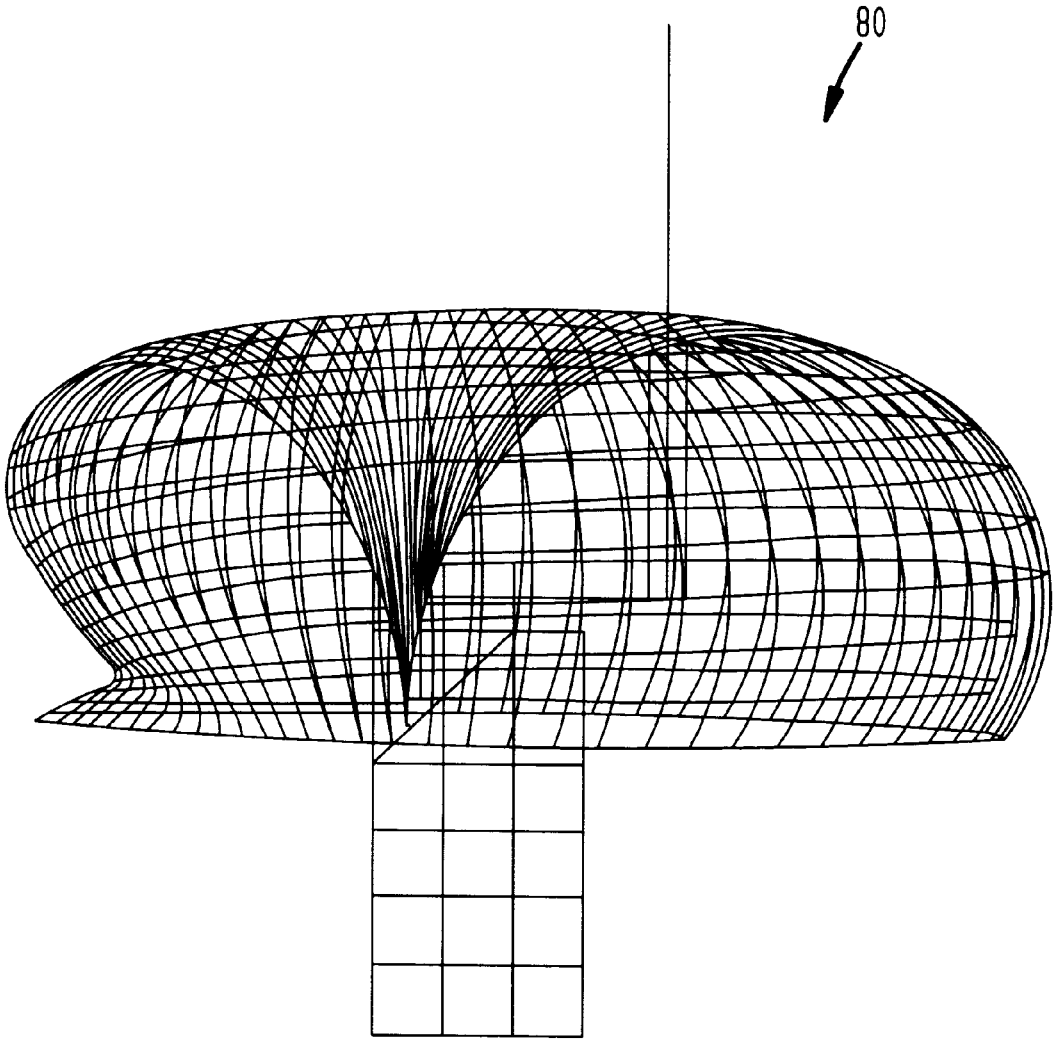
FIG. 12B shows a simulated three-dimensional representation of the antenna surface pattern for the antenna and receiving device of FIG. 11.

FIG. 12A shows a graph 78 of the radiation of the antenna, in which the level of radiation in decibel-microvolts (dB$\mu$V) is graphed against the angle Phi in a horizontal plane passing through the upright antenna. FIG. 12B shows a three-dimensional simulated representation 80 of the surface pattern of the antenna radiation. In this representation 80, the antenna lies along the z-axis, with the body of the radio housing extending to the right of the antenna along the x-axis. The radiation patterns shown in FIGS. 12A and 12B illustrate the omni-directionality of the antenna, and are comparable to the patterns of antennas manufactured using prior art techniques illustrated in FIGS. 1–4, discussed above.

The above-described antenna according to the present invention has a number of advantages over the prior art. First, it uses fewer parts than the antenna shown in FIGS. 1–4 and described above. Instead of using a shield pipe and conical mounting device, the present invention uses a single shield plate that can be easily fabricated from a single sheet of metal. Also, as discussed above, it requires skill to attach the prior art shield to a coaxial cable. It requires relatively less skill and time to mount an antenna shield according to the present invention to a coaxial cable. These factors lead to significant savings in manufacturing costs. Further, because the shield plate is lighter than the prior art shield pipe, the resulting antenna has a lower weight than the prior art antenna.

While the foregoing description includes detail which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

We claim:

1. A collinear antenna, comprising:

a shield having a plate section abutting a length of coaxial cable, the coaxial cable having an inner conductor and an outer conductor, the shield further having a head section extending from one end of the plate section, the head section gripping an exposed portion of the outer conductor of the coaxial cable, the inner conductor of the coaxial cable extending beyond the head section; and a main radiator attached to the inner conductor of the coaxial cable at a predetermined distance from the shield.

2. The collinear antenna of claim 1, wherein the head section includes a first pair of side tabs forming a first clip for gripping the exposed portion of the outer conductor of the coaxial cable, the outer conductor of the coaxial cable extending through the first clip with the inner conductor of the coaxial cable extending beyond the first clip.

3. The antenna of claim 2, wherein the first pair of side tabs is deformable, and wherein the first pair of side tabs is bent to grip the outer conductor of the coaxial cable.

4. The antenna of claim 3, wherein the coaxial cable has an outer insulator surrounding the outer conductor, and wherein the head section further includes a second pair of side tabs forming a second clip, located between the first clip and the plate section, for gripping the outer insulator of the coaxial cable.

5. The antenna of claim 4, wherein the second pair of side tabs is deformable, and wherein the second pair of side tabs is bent to grip the outer insulator.

6. The collinear antenna of claim 1, wherein the plate section of the shield has a pair of side panel members, the plate section and the pair of side panel members together forming a bridge, the length of coaxial cable extending between the side panel members.

7. The antenna of claim 6, further including a dielectric sleeve placed around the coaxial cable between the side panel members and abutting the plate section.

8. The antenna of claim 7, wherein the side panel members are deformable, and wherein the side panel members are bent to grip the dielectric sleeve.

9. The antenna of claim 6, wherein each of the side panel members includes a notch, each notch extending from approximately the midpoint of each side panel to a point proximate to a tail end of the plate section away from the head section.

10. The antenna of claim 9, wherein the length of coaxial cable is folded away from the tail end of the plate section for connection into a device.

11. The antenna of claim 1, wherein the shield is fabricated from a single sheet of metal.

12. The antenna of claim 11, wherein the shield is coated with a conductive material.

13. A shield for use in a collinear antenna fed by a coaxial cable having an inner conductor and an outer conductor, the shield comprising:

a plate section;

a head section extending from one end of the plate section, the head section having a first pair of side tabs forming a clip for gripping an exposed portion of the outer conductor of a coaxial cable abutting the plate section, the inner conductor of the coaxial cable extending beyond the head section for connection to main radiator at a predetermined distance from the shield.

14. The shield of claim 13, wherein the head section includes a second pair of side tabs, located between the first pair of side tabs and the plate section, for gripping an outer insulator of the coaxial cable.

15. The shield of claim 13, wherein the plate section includes a pair of side panels, the plate section and the side panels together forming a bridge.

16. The shield of claim 13, wherein the shield is fabricated from a single sheet of metal.

17. The shield of claim 16, wherein the shield is plated with a conductive material.

18. A method for manufacturing an antenna, comprising the following steps:

(a) stripping one end of a coaxial cable to expose predetermined sections of the coaxial cable's inner conductor, inner insulator, and outer conductor;

(b) placing a dielectric sleeve over the coaxial cable's outer insulator proximate to the stripped end of the cable;

(c) placing over the sleeve a shield having a plate section including a pair of deformable side panels, the plate section and the side panels together forming a bridge fitting around the sleeve, the shield further having a head section extending from the plate section, the head section having a first pair of deformable side tabs forming a clip for gripping an exposed portion of the outer conductor of the coaxial cable;

(d) bending the side panels of the plate section to grip the dielectric sleeve;

(e) bending the side tabs of the head section to grip the outer conductor of the coaxial cable; and (f) and attaching a main radiator to the inner conductor of the coaxial cable at a predetermined distance from the shield.

19. The method of claim 18, further including the following step (e1) performed after step (e):

(e1) soldering the outer conductor of the coaxial cable to the head section.

* * * * *